US009714154B2

(12) United States Patent
Haldorsen et al.

(10) Patent No.: US 9,714,154 B2
(45) Date of Patent: Jul. 25, 2017

(54) REEL WITH REPLACEABLE DRUM AND A METHOD FOR USING SAME

(71) Applicant: Advantec AS, Stord (NO)

(72) Inventors: Rolf Haldorsen, Rubbestadneset (NO); Kenneth Kvernenes, Stord (NO); Svein Gravdal, Stord (NO)

(73) Assignee: Advantec AS, Stord (NO)

( * ) Notice: Subject to any disclaimer, the term of this patent is extended or adjusted under 35 U.S.C. 154(b) by 412 days.

(21) Appl. No.: 14/467,711

(22) PCT Filed: Feb. 27, 2013

(86) PCT No.: PCT/NO2013/050039
§ 371 (c)(1),
(2) Date: Aug. 25, 2014

(87) PCT Pub. No.: WO2013/129937
PCT Pub. Date: Sep. 6, 2013

(65) Prior Publication Data

US 2015/0298936 A1 Oct. 22, 2015

(30) Foreign Application Priority Data

Feb. 28, 2012 (NO) ..... 20120220

(51) Int. Cl.
*B65H 67/00* (2006.01)
*B65H 75/44* (2006.01)
*B65H 67/06* (2006.01)

(52) U.S. Cl.
CPC ..... *B65H 75/4407* (2013.01); *B65H 67/06* (2013.01); *B65H 75/4402* (2013.01);
(Continued)

(58) Field of Classification Search
CPC B65H 75/4407; B65H 67/06; B65H 75/4402; B65H 75/4471; B65H 2701/32; B65H 2701/33; B65H 2701/34
See application file for complete search history.

(56) References Cited

U.S. PATENT DOCUMENTS 4,594,871 A * 6/1986 de Boer ..... B65H 57/00 405/166
5,839,514 A * 11/1998 Gipson ..... E21B 19/22 166/384

(Continued)

FOREIGN PATENT DOCUMENTS

| | | |
|---|---|---|
| AU | B-15080/92 | 4/1992 |
| NO | 328052 | 11/2009 |
| WO | 2009131465 | 10/2009 |

OTHER PUBLICATIONS

International Search Report and Written Opinion for PCT/NO2013/050039 dated May 28, 2013.

*Primary Examiner* — William A Rivera
(74) *Attorney, Agent, or Firm* — Andrus Intellectual Property Law, LLP

(57) ABSTRACT

A reel and a method for use of same are arranged for supporting a cable drum. The reel comprises a reeling device for controlling the cable and at least one drive unit for provision of rotation of the cable drum for out- and in-winding of the cable, where the reeling device comprises two cable guiding portions which in a position of use are held at a mutual distance and connected to a reeling carriage by brackets arranged in each of the end portions of the cable guiding portions. At least one portion of the reeling device is releasably arranged to the reeling carriage so that the cable guiding portion or parts of this may be lifted out of, or displaced to the side in the framework, so that the cable drum may be removed from the reel.

12 Claims, 8 Drawing Sheets

(52) U.S. Cl.
CPC ..... *B65H 75/4471* (2013.01); *B65H 2701/32* (2013.01); *B65H 2701/33* (2013.01); *B65H 2701/34* (2013.01)

(56) References Cited

U.S. PATENT DOCUMENTS

| | | | | |
|---|---|---|---|---|
| 5,950,953 | A | 9/1999 | Baugh et al. | |
| 6,527,215 | B1 * | 3/2003 | Cain | B65H 75/14 242/394 |
| 6,957,929 | B1 * | 10/2005 | Rachel | B63B 35/04 242/390 |
| 7,210,647 | B2 | 5/2007 | Dion | |
| 2003/0006034 | A1 * | 1/2003 | Neal | B65H 75/4402 166/77.2 |
| 2006/0273213 | A1 * | 12/2006 | Turk | B65H 75/425 242/397.3 |
| 2007/0210199 | A1 * | 9/2007 | Shampine | B65D 19/08 242/399 |
| 2012/0247579 | A1 * | 10/2012 | Park | B65H 75/38 137/355.26 |

* cited by examiner

REEL WITH REPLACEABLE DRUM AND A METHOD FOR USING SAME

CROSS-REFERENCE TO RELATED APPLICATIONS

This application is the U.S. national stage application of International Application PCT/NO2013/050039, filed Feb. 27, 2013, which international application was published on Sep. 6, 2013, as International Publication WO2013/129937 in the English language. The international application is incorporated herein by reference, in entirety. The International application claims priority to Norwegian Patent Application No. 20120220, which is incorporated herein by reference.

FIELD

The present invention relates to a reel arranged to be able to carry a cable drum. More specifically the invention relates to a reel arranged to carry a cable drum, where the reel includes a reeling device for controlling the cable. The invention also relates to devices for facilitating and securing replacement of the cable drum onshore and on floating offshore installations and vessels.

BACKGROUND

In this document, the term reel denotes a frame or a container arranged to be able to carry, operate and control a cable drum with a cable, for example a so-called umbilical. In this technical field a frame construction of the type referred to herein, is called a reel.

A frame construction or so-called reel which includes drive units and appurtenant drum, is well-known from the industry related to offshore exploration and production of petroleum, amongst others. Description of such reels is known from Norwegian Patent No. 328052 and from the American patents U.S. Pat. No. 5,950,953 and U.S. Pat. No. 7,210,647 and from the Australian publication AU-B 150080/92.

During such offshore operations, and more specifically in connection with installation and removal of subsea production tools on the seabed and during maintenance and surveying, so-called work-over, in subsea wells, it is common to control the operations from the surface by means of the so-called umbilical which may comprise electric cables, hydraulic tubing and fiber-optic cables. As the umbilical, in the following also called cable, is a critical tool in connection with such installation and maintenance operations, it is a requirement that it should be possible to replace the cable if it fails, is damaged or cut off.

Thus it has been common practice to make demands for a complete back-up reel to be present, in order for the reel and cable to be replaced with a new one if necessary.

Such reels as mentioned herein, are very costly as they are complete units including a support frame, motor, gears and control systems. As the support frame itself is an elevator device, more authorities make demands for frequent certification.

There is limited space on an offshore installation. Normally there is thus not enough room for storing a spare reel on the installation. Instead it is common to store such reels onshore. A cable break-down or cable damage may thus result in a relatively long stop in for example an offshore operation. Additionally, some offshore installations will have limitations as to how heavy units may be brought onboard in one lift, and in the case of larger reels it may be required to be able to lift the cable drum and the reel separately.

In the offshore industry there has long been a wish for the ability to replace a damaged cable with a new one, by replacing the cable drum as such, complete with the cable wound up, and that such replacement should be possible to perform offshore. Norwegian Patent NO 328052 discloses a reel with a rotatable reeling device and a method for use of same. Although the reel in accordance with NO 328052, works satisfactorily regarding being able to remove the cable drum from the reel, it is infested with some disadvantages. Onboard a floating installation or a vessel, considerable movements, related to waves, might appear. These movements make the rotation of the reeling device more difficult and require a relatively strong supporting construction for the reeling device. On lifting the cable drum in or out, the reeling device in accordance with NO 328052 may tower over the top portion of the reel and protrude out further than a side portion of the reel. Thus the reel will take up space both above and to a side portion of the reel, at the same time as the reeling device may be exposed to damage if the cable drum collides with the reeling device on in- or out-lifting, for example due to wave motions. Thus there is a need for being able to simplify removal of the reeling device in connection with lifting of the cable drum into or out of the reel. Further there is a pronounced desire to provide an arrangement for securing and limiting of the movements of the cable drum caused by the influence of waves, by providing secure guiding of the cable drum into and out of the reel in order to avoid damage of the cable drum or the reeling device.

SUMMARY

The invention has for its object to remedy or to reduce at least one of the disadvantages of prior art.

The object is attained through features described below and in the subsequent patent claims.

In a first aspect of the present invention there is provided a reel arranged for supporting a cable drum, where the reel comprises a reeling device for guiding of the cable and at least one drive unit for generating rotation of the cable drum for out- and in-winding of a cable, the reeling device comprising two cable guiding portions, which in a position of use are kept at a mutual distance and fastened to a reel carriage by means of brackets arranged at each of the end portions of the cable guiding portions, at least a portion of the reeling device being releasably connected to the reel carriage so that the cable guiding portions or parts of this, may be lifted out of, or displaced to the side in the framework, such that the cable drum may be removed from the reel.

The drive unit may be installed inside of the cable drum which may be provided with bearing rings enveloped by bearing brackets and where at least one of these is fastened to a motor bracket such that the reel with bearing bracket and motor bracket and also drive unit is stationary, while the outlet of the drive unit which is a rotating drive shaft is connected to the cable drum and thus transmits the rotating movement to the cable drum. This has the effect that for example a cable drum with a damaged cable may be lifted out from the reel in one piece, and the spare cable drum may be lifted inside, where it may be presumed that the spare cable drum may be fully equipped with cable, connection details for each end of the cable, wherein different instruments and control units installed at the sidewall of the cable drum, may be included, and the drive unit may be pre-installed inside the cable drum. This way the time consumed by replacing cable drums provided with such an internal drive unit, may be considerably reduced.

It is an advantage if the cable drum is supported in each end, typically by use of so-called slewing ring bearings, where each of these is enveloped by bearing brackets fastened to the reel in so-called bearing bases, and where the drive unit inside of the cable drum is typically installed via at least one motor bracket which is static and fastened to the reel via at least the one bearing bracket, and where the drive unit is provided with a gear arranged to be able to go into engagement with the cable drum, and is arranged so that ft may be rotated in the one or the other rotational direction.

The reel may further be provided with guiding brackets arranged to be able to switch between a passive position where the guiding brackets constitute an integral part of the reel and an active position where the guiding brackets are arranged in an approximately vertical position where they are connected to the reel for guiding of the installation and out-lifting of the cable drum. This has the effect that the guiding brackets absorb any movements of the cable drum in connection with lifting offshore where the installation and thus the devices which are lifted, may be expected to move as a consequence of waves.

The guiding brackets arranged to be able to guide the cable drum on in- and out-lifting of the reel, may for example be designed in a way which enables them to be pre-mounted and preferably integrated in the reel, and may be released and for example rotated from a horizontal to a typically vertical position, and thereafter connected to the reel in the new position.

The guiding brackets may in the active position tower over a top portion of the reel. This has the effect that the guiding brackets meet the cable drum and give a preliminary guiding of the cable drum on lifting it in, before it gets into engagement with the reel.

It is preferable if cable drum, guiding brackets and reel with bearing bases are arranged so that the cable drum guides more and more precisely against the bearing bases on lowering, in a way that gradually reduces the freedom of movement for the cable drum, in order to avoid damaging the equipment and to reduce the need for fine adjustments when said bearing brackets are to be bolted to the bearing bases. The guiding will then be able to function the other way around on lifting the cable drum out from the reel.

It is an advantage if the reel is arranged for adjustment of the guiding brackets to for example horizontal position without requiring use of the lifting devices of the installation or the vessel, for example by use of a ladder step and other devices where up to two persons may work without requiring special equipment for work at height.

It is an advantage if the reel is provided with a removable protective screen for facilitating access for example in connection with a possible necessary adjustment of the guiding brackets.

It is an advantage if all fastening bolts between the bearing bracket and the bearing base are arranged such that they may be released and fastened from the outside of the reel. It is thus an aspect of the invention that there should be no need for personnel to be present inside of the reel during in- or out-lifting of the cable drum, or on mounting of same.

According to a second aspect of the present invention a method for removing or arranging a cable drum in a reel, where the reel includes a reeling device as stated in the first aspect of the invention, in order to be able to control out- and in-winding of cable on the cable drum, and at least one driving means in order to provide rotation of the cable drum, is provided, the method comprising to release the reeling device from a reel carriage, so that a cable guiding portion or parts of this may be lifted out of the reel or displaced to the side in the framework.

BRIEF DESCRIPTION OF THE DRAWINGS

In the following an example of a preferred embodiment which is illustrated in the enclosed drawings, is described, where.

DETAILED DESCRIPTION OF THE DRAWINGS

Figure 1:
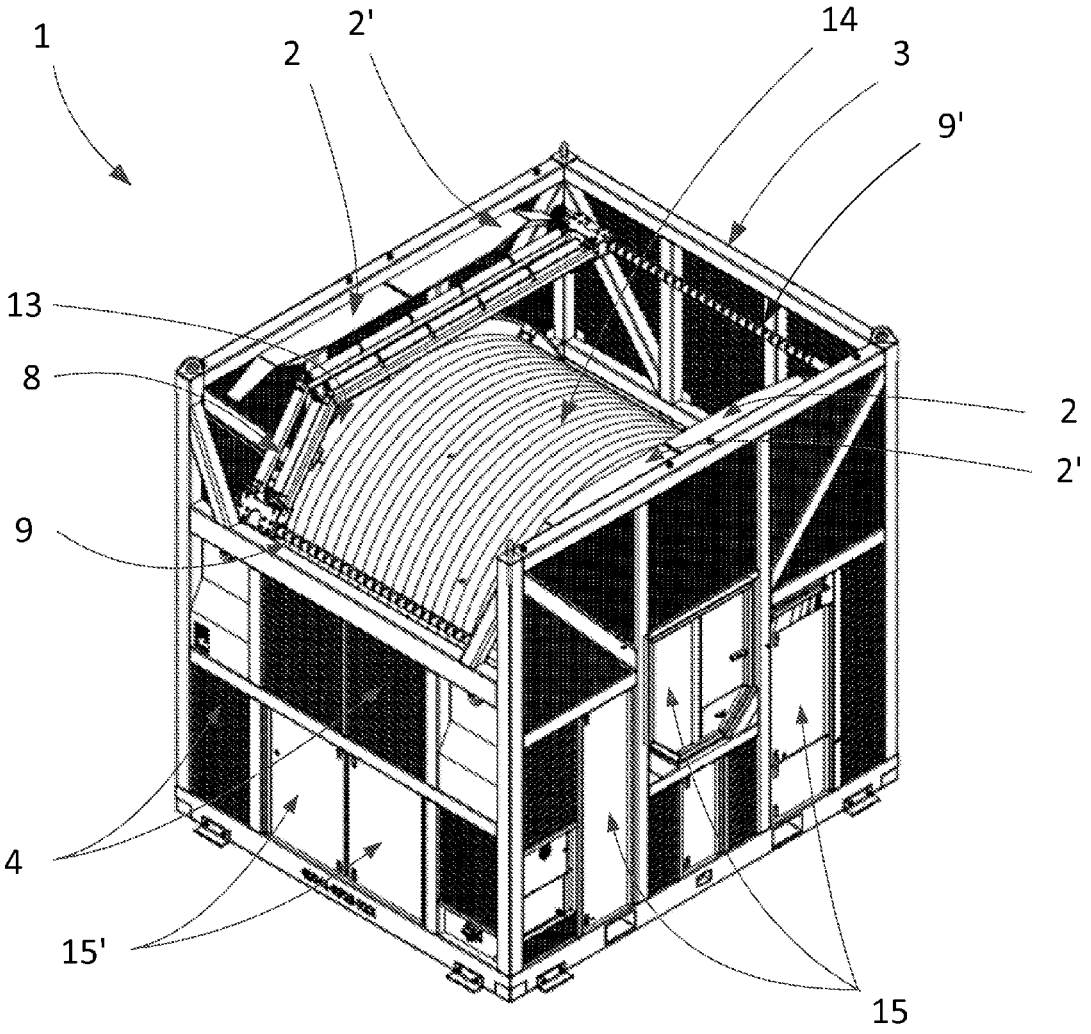
FIG. 1 shows a perspective view, seen from above and at an angle, of a reel according to the present invention, where the reel carries a cable drum.

In the figures the reference number 1 indicates a reel in accordance with the present invention. The reel 1 includes guiding brackets 2, 2', a frame construction 3 with bearing bases 3', 3", a cable drum 13, a drive unit 5, a reeling device 7 with a cable guiding portion 8 and bearing brackets 12, 12'. The cable guiding portion 8 includes rollers 8'.

For the sake of clarity only a few of the components shown in the figures are denoted with reference numbers. A person skilled in the art will understand the object of the components shown, but which are not further described in the following.

The reel 1 is arranged to be able to carry a cable drum 13 with an on-winded cable 14.

Figure 6:
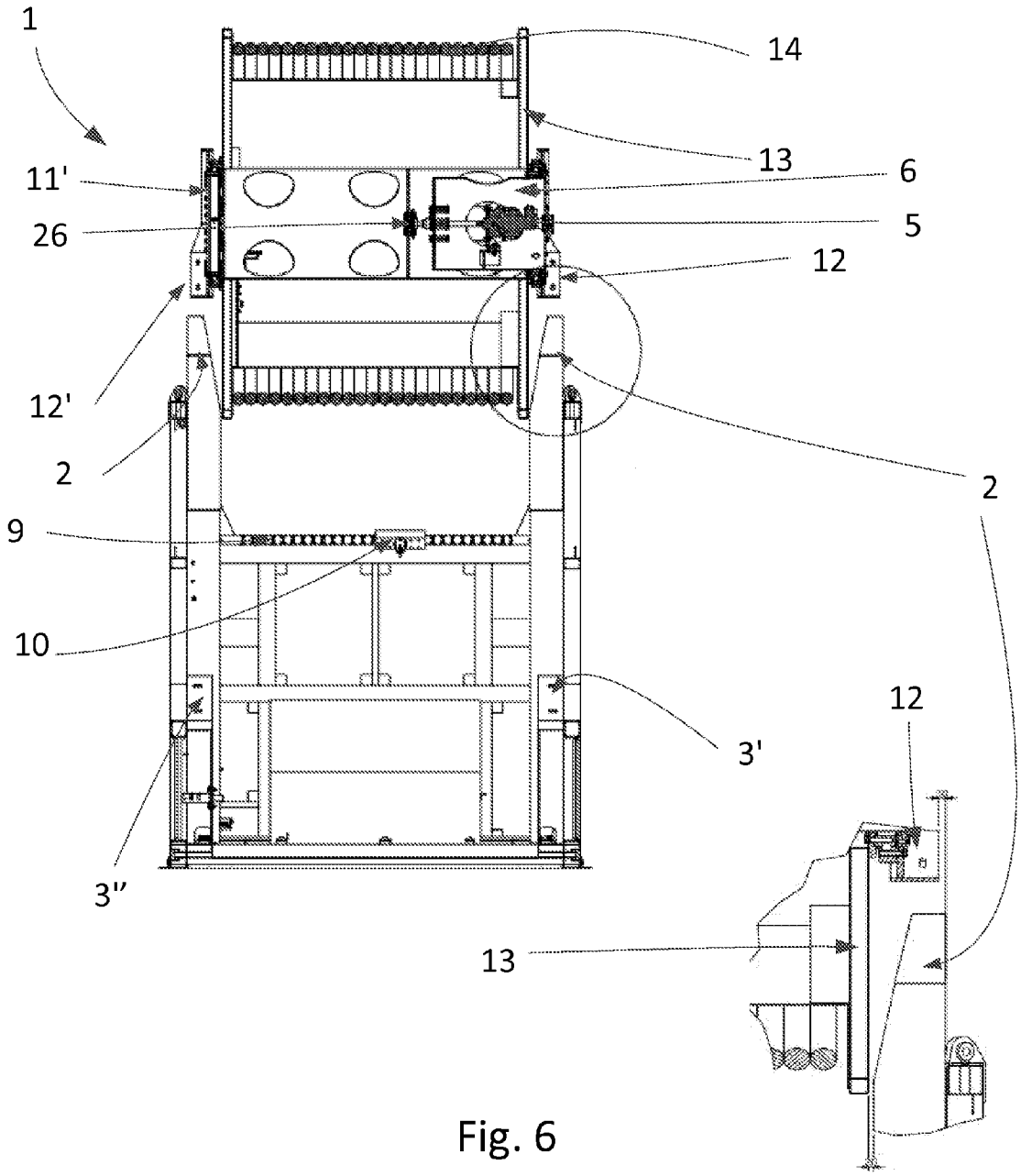
FIG. 6 shows the cable drum, shown partly as a cross section, as it is about to be lifted into the reel, and where guiding brackets are arranged in an upwardly protruding position so that they may guide the cable drum down into the reel.

In the shown embodiment, a drive unit 5 is mounted inside of a stationary motor bracket 6 (see FIG. 6). The motor bracket 6 is bolted to a bearing bracket 12 arranged in such a way that it encircles a bearing ring arranged on the right side in FIG. 6. The drive unit 5 is provided with a driving axle 26 which in a known way per se is arranged to go into engagement with fastening means inside of the cable drum 13.

A further bearing ring 11' is placed outside on the left side (see FIG. 6) of the flange of the drum, and is arranged in such a way that it envelopes a bearing bracket 12' and thus supports the opposite side of the cable drum 13 during operation.

In FIG. 1 the reel 1 is shown in a typical position of use. A protective screen 4 is arranged in portions of the framework 3. The object of the protective screen 4 is both to provide protection for the contents of the reel 1 and to reduce the risk of personnel getting into contact with rotating parts present inside the reel 1. The protective screen 4 is arranged to be removable. The reeling device 7 comprises two cable guiding portions 8 which in a position of use are held at a mutual distance and connected to a reel carriage 10, 10' by means of brackets arranged in each of the end portions of the cable guiding portions 8. The cable guiding portion 8 is in the shown embodiment connected to reel carriages 10 and 10' by means of screws such that the brackets of the cable guiding portions 8 may be loosened and removed completely from the reel carriages 10, 10'.

In the shown embodiment, the cable guiding portion 8 of the reeling device 7 is provided with an angled design. The cable guiding portion 8 is defined by a plurality if rollers 8'. The cable 14 may be able to run steplessly between a substantially horizontal and a vertical position in the cable guiding portion 8, due to the angled design.

Figure 2:
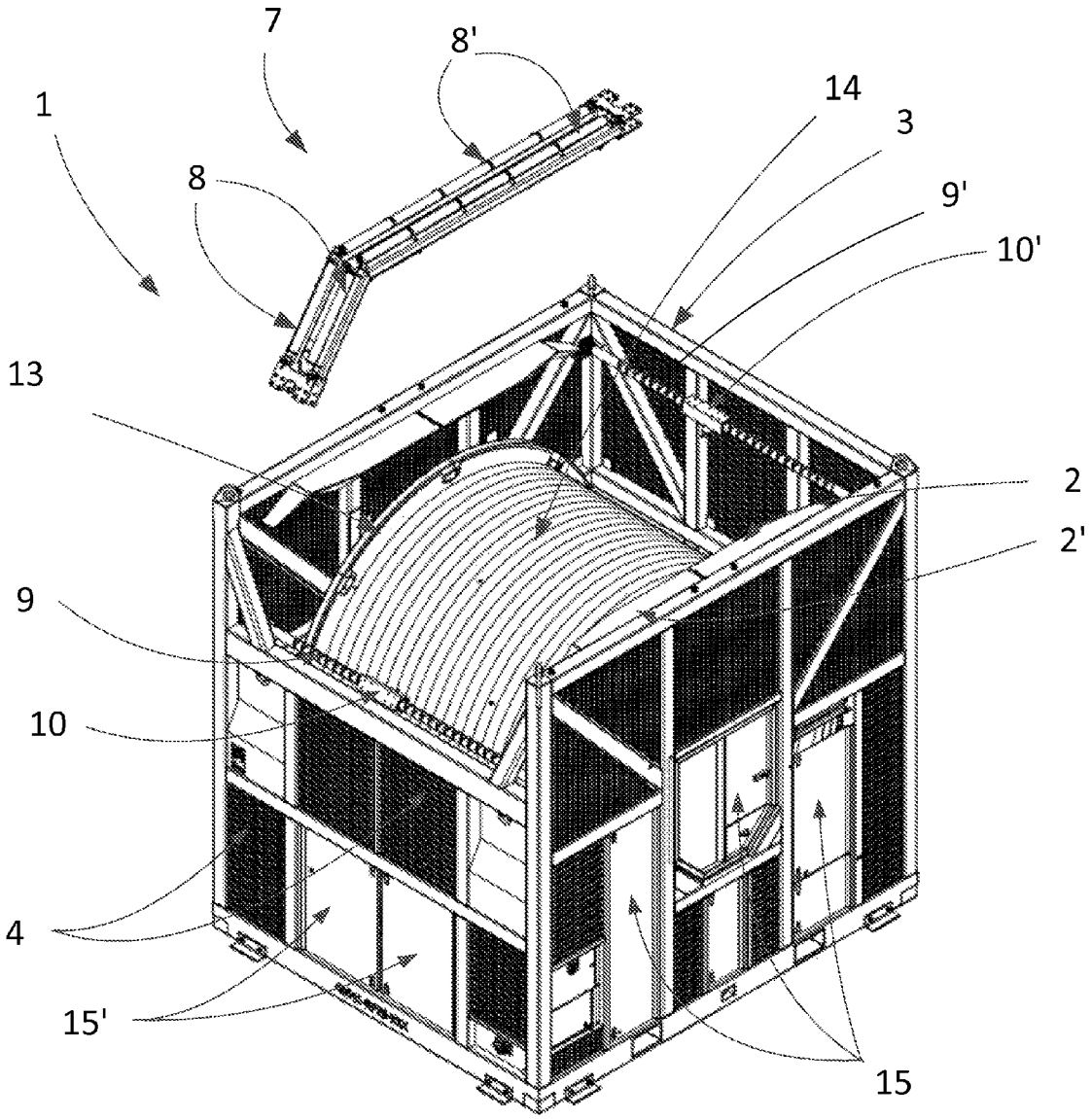
FIG. 2 shows the reel in FIG. 1 where the cable guiding portion is lifted out, and where reel carriages are positioned towards the center of each of the coil screws.

In FIG. 2 the reel 1 is shown after the cable guiding portion 8 together with rollers 8' is about to be removed from the reel 1, and the reel carriages 10, 10' are displaced towards the center of coil screws 9, 9'. A hoisting device for the cable guiding portion 8 is not shown, neither is a lifting device which connects the cable guiding portion 8 to the hoisting device. It is to be emphasized that the cable guiding portion 8 in a not shown alternative embodiment is arranged such that it may not be lifted out, but may be divided into two separate units for example rotated or turned out to the coil screws 9 and 9'.

Figure 3:
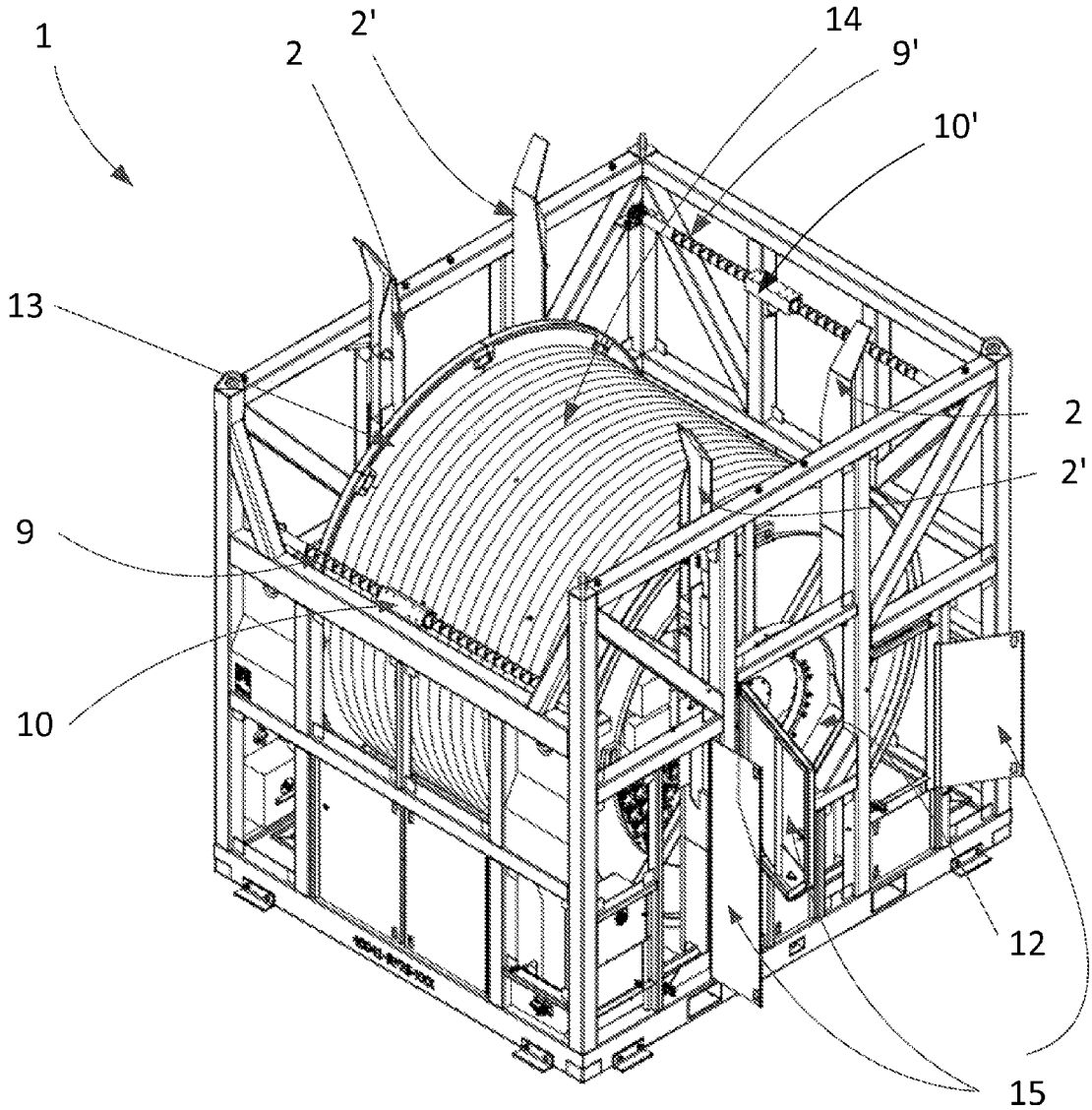
FIG. 3 shows the reel in FIG. 2 after removal of a protective screen, the door panels are open and guiding brackets are rotated from horizontal and to vertical position.

In FIG. 3 the reel 1 is shown after removal of the protective screen 4 in order to provide access inside the framework 3, a door panel 15 is opened and the guiding brackets 2, 2' are rotated to a vertical position.

Ladder rungs and temporary platforms necessary for running this operation without the use of a hoisting device and lifting devices, are not shown.

Figure 4:
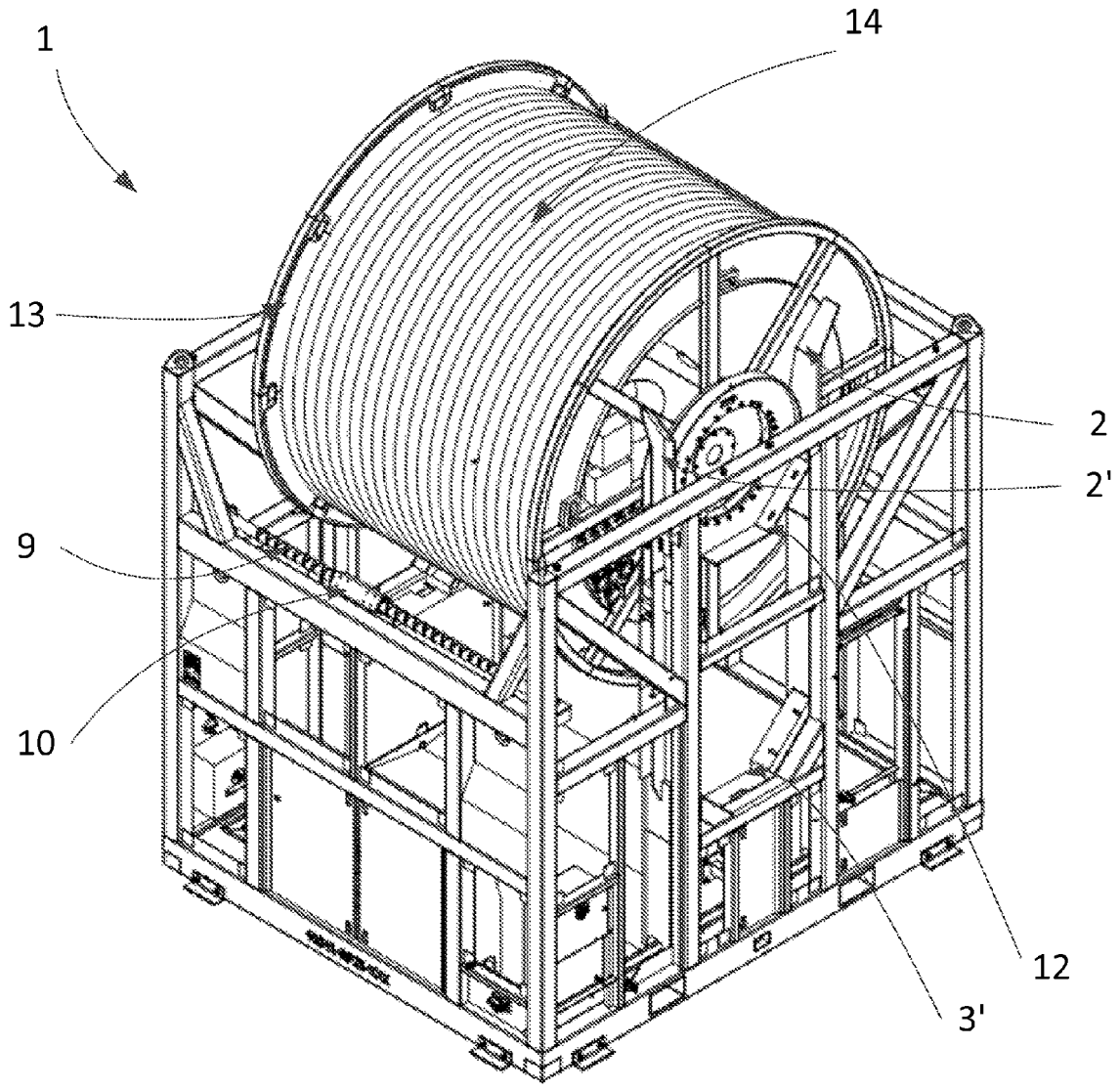
FIG. 4 shows the cable drum as it is about to be removed from the reel.

In FIG. 4 the door panel 15 is removed and the cable drum 13 is shown as it is introduced into or removed from the reel 1. The hoisting device is not shown, neither is a lifting device connecting the cable drum 13 to the hoisting device.

Figure 5:
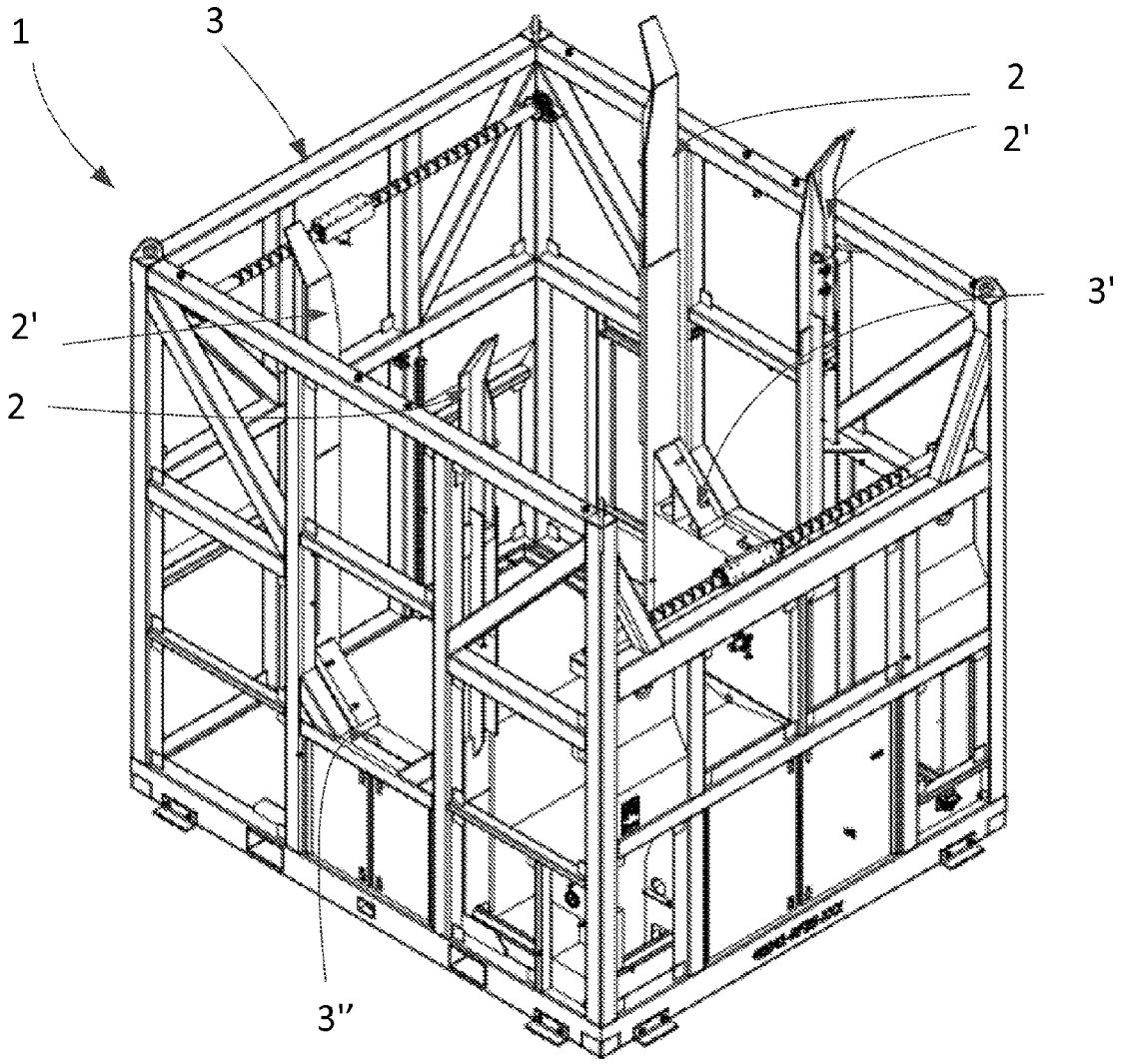
FIG. 5 shows the reel after removal of the cable drum.

In FIG. 5 the reel 1 is shown after removal of the cable drum 13.

FIG. 6 shows the operation where the cable drum is about to be lifted into the reel 1 and where the preliminary guiding is provided by means of the framework 3 and the guiding brackets 2, 2'.

Figure 7:
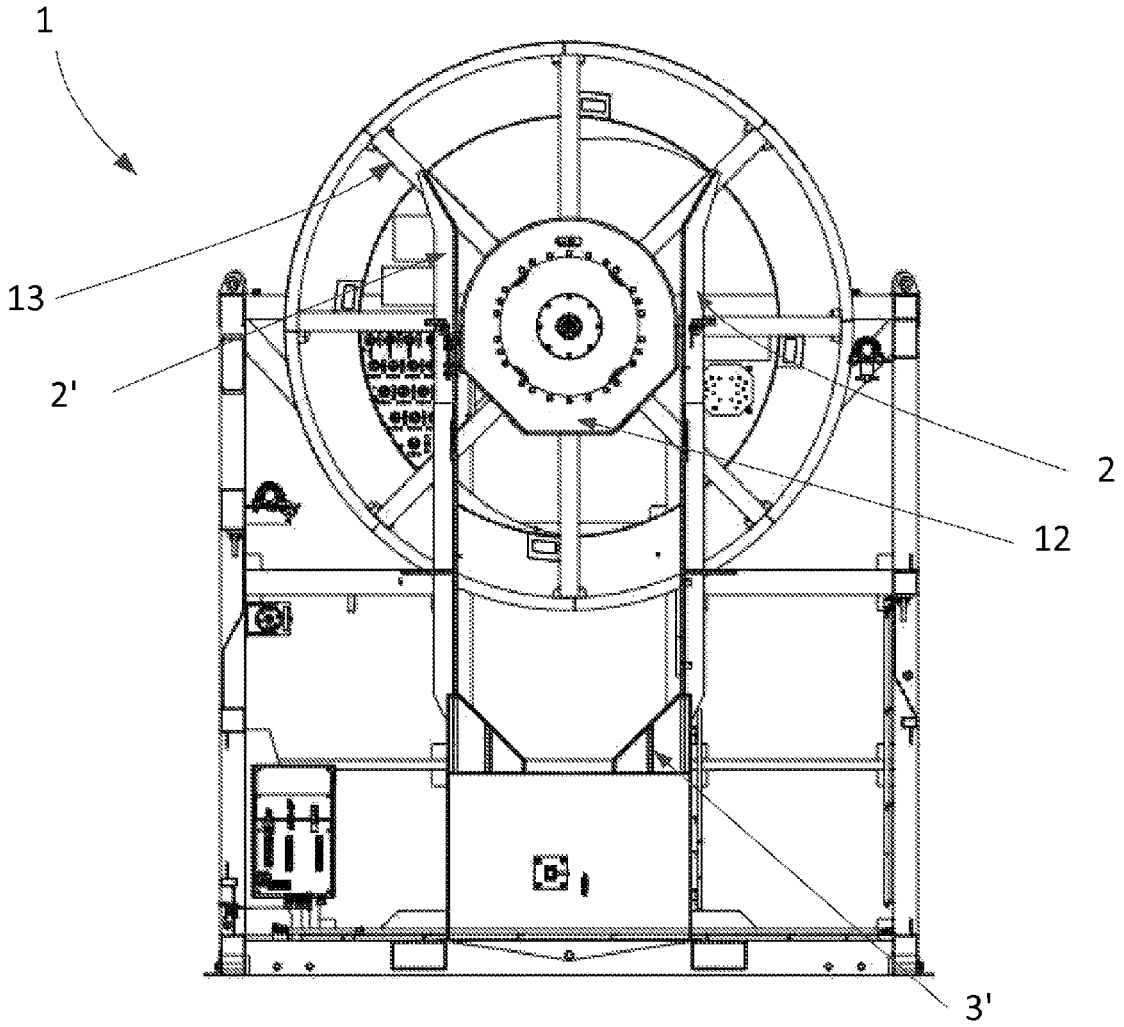
FIG. 7 shows how the cable drum is guided down into the reel through the given design of the reel, without having construction details or parts of the machinery damaged by the drum.

In FIG. 7 it is shown how the cable drum is guided down into the reel 1 through the given construction design, and where the guiding brackets 2, 2' make sure there is little movement of the cable drum 13 and thus prevent damages of other construction details or parts of the machinery by the cable drum 13.

Figure 8:
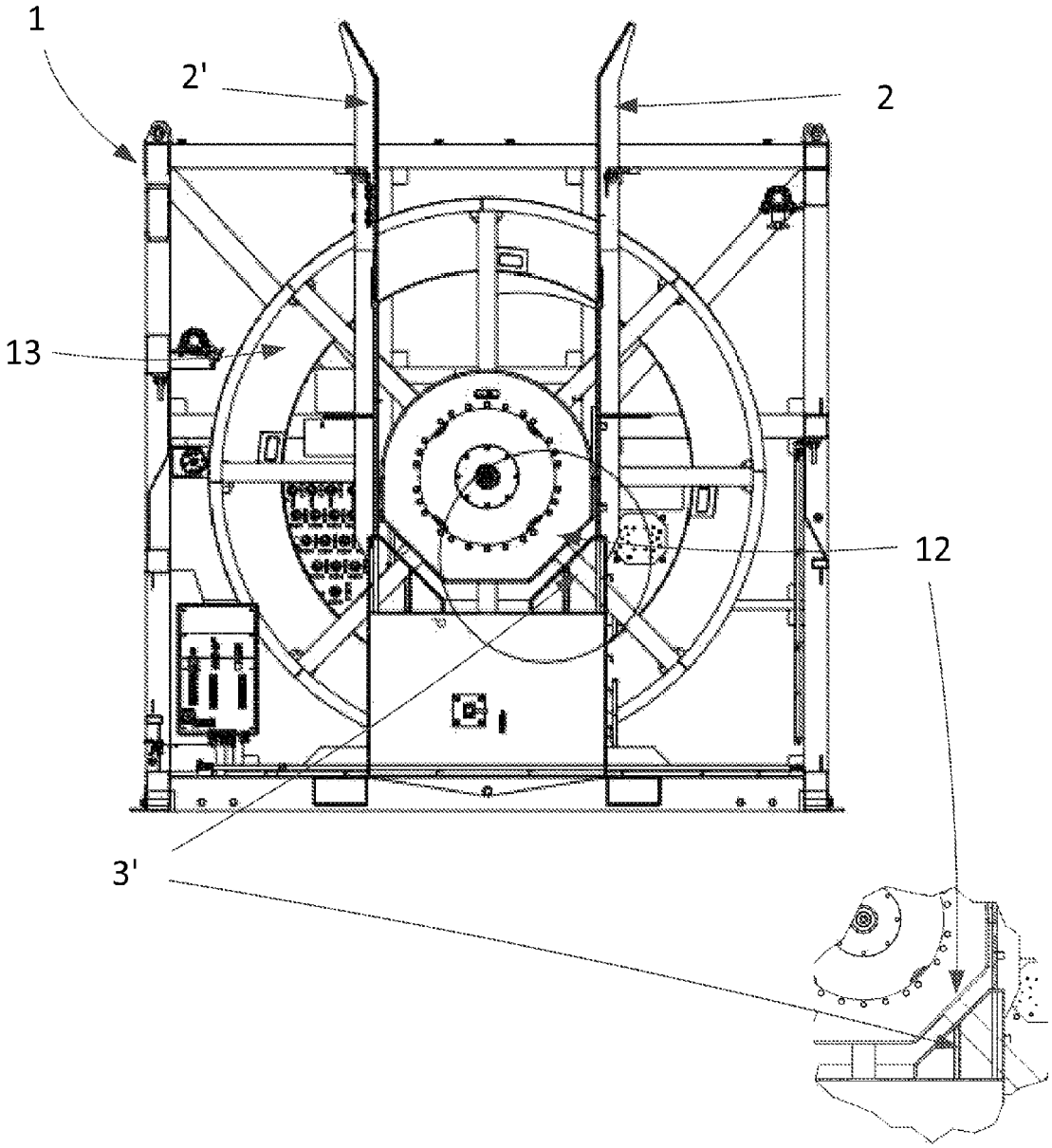
FIG. 8 shows how the design of the bearing bracket and the bearing base contribute to the fine adjustment of the position of the cable drum on lowering of the cable drum inside the reel.

FIG. 8 shows how the bearing brackets 12, 12' and the design of the bearing base 3', 3" contributes to the fine adjustment of the position of the cable drum 13 on lowering inside the reel 1.

The present invention thus solves the introductorily mentioned problems related to replacing a cable 14 in a reel, where it may be foreseen that the cable drum 13 may get an unwanted movement caused by a wave movement inflicted on the installation or vessel on in- or out-loading. Aspects of the invention concerns design and devices which additionally guide the cable drum 13 in, and possibly out, of the reel 1, where a larger movement in the top portion is tolerated, and where the design of the guiding system guides the cable drum 13 closer to its position in the bearing base 3', 3" on in-loading, and where the guiding system is arranged for preventing damage of the cable drum 13, the framework 3 and other apparatuses or machinery.

The invention claimed is:

1. A reel arranged for supporting a cable drum, the reel comprising a reeling device for controlling the cable, a framework having a reeling carriage, and at least one drive unit for rotating the cable drum for out- and in-winding of the cable, wherein the reeling device comprises two cable guiding portions, each having end portions, wherein each cable guiding portion, in a position of use, is held at a mutual distance and connected to the reeling carriage by brackets arranged in each of the end portions of the respective cable guiding portions, wherein at least a portion of the reeling device is releasably arranged to the reeling carriage so that at least part of each cable guiding portion may be lifted out of, or displaced to the side in the framework, so that the cable drum may be removed from the reel.

2. The reel in accordance with claim 1, where the drive unit is mounted inside of the cable drum which is provided with bearing rings enveloped by bearing brackets and where at least one of the bearing brackets are connected to a motor bracket such that the reel with bearing bracket and the motor bracket and also the drive unit are stationary, while an outlet of the drive unit which is a rotating drive axle is connected to the cable drum and thus transmits the rotational movement to the cable drum.

3. The reel in accordance with claim 2, where bearing brackets of the cable drum are arranged so that together with the guiding brackets, the bearing brackets are configured to guide the cable drum on in-lifting and lowering until the bearing brackets land on a predetermined point on the bearing base, such that fastening bolts may be mounted without any further fine adjustment of the position of the cable drum.

4. The reel in accordance with claim 1, further comprising rotatable guiding brackets for guiding the cable drum in and out of the reel, a portion of the guiding brackets being rotatable from a substantially horizontal, passive position, to a substantially vertical, active position, a portion of the guiding brackets being connected to the framework of the reel.

5. The reel in accordance with claim 4, where the guiding brackets in the active position extend above a top portion of the framework of the reel.

6. The reel in accordance with claim 4, where the guiding brackets in the passive position are below or in plane with a top portion of the framework of the reel.

7. The reel in accordance with claim 4, where bearing brackets of the cable drum are arranged so that, together with the guiding brackets, the bearing brackets are configured to guide the cable drum on in-lifting and lowering until the bearing brackets land on a predetermined point on the bearing base, such that fastening bolts may be mounted without any further fine adjustment of the position of the cable drum.

8. The reel in accordance with claim 1, where the reel is further provided with a removable protective screen.

9. A method for removing and arranging a cable drum in a reel, the reel comprising a framework having a reeling carriage, and a reeling device configured to control out- and in-winding of cable on the cable drum, the reeling device comprising two cable guiding portions, each having end portions, wherein each cable guiding portion, in a position of use, is held at a mutual distance and connected to the reeling carriage by brackets arranged in each of the end portions of the respective cable guiding portions, wherein at least a portion of the reeling device is releasably arranged to the reeling carriage so that at least part of each cable guiding portion may be lifted out of, or displaced to the side in the framework, so that the cable drum may be removed from the reel; and at least one drive unit configured to provide rotation of the cable drum, wherein the method comprises:

releasing the reeling device from the reel carriage so that at least part of the cable guiding portion can be lifted out of the reel or displaced to the side in the framework, and removing the cable drum after the cable guiding portion has been lifted out of the reel or displaced to the side in the framework.

10. The method in accordance with claim 9, further comprising mounting guiding brackets in vertical position such that the cable drum is prevented from unintentional movement of the cable drum on in- and out-lifting in the reel and so that the guiding brackets guide the cable drum in towards a finer control system constituted of bearing brackets and a bearing base.

11. The method in accordance with claim 9, where the cable drum is run out of and into the reel by a hoisting device.

12. The method in accordance with claim 9, where the bearing brackets are bolted to bearing bases as the cable drum is guided into position.

* * * * *